US008246435B2

(12) United States Patent
Hall

(10) Patent No.: US 8,246,435 B2
(45) Date of Patent: Aug. 21, 2012

(54) BLACKJACK VARIATION WITH REDUCED PLAY DECISIONS

(76) Inventor: Geoff Hall, Solihull (GB)

( * ) Notice: Subject to any disclaimer, the term of this patent is extended or adjusted under 35 U.S.C. 154(b) by 172 days.

(21) Appl. No.: 12/616,766

(22) Filed: Nov. 11, 2009

(65) Prior Publication Data

US 2010/0167803 A1 Jul. 1, 2010

Related U.S. Application Data

(60) Provisional application No. 61/113,563, filed on Nov. 11, 2008.

(51) Int. Cl.

| | |
|---|---|
| ***A63F 9/24*** | (2006.01) |
| ***A63F 13/00*** | (2006.01) |
| ***A63F 1/00*** | (2006.01) |
| ***A63F 9/20*** | (2006.01) |
| ***G06F 17/00*** | (2006.01) |
| ***G06F 19/00*** | (2011.01) |

(52) U.S. Cl. ..... 463/12; 463/13; 463/16; 463/20; 463/25; 273/292

(58) Field of Classification Search ..... 463/12, 463/13, 16, 20, 25; 273/292
See application file for complete search history.

(56) References Cited

U.S. PATENT DOCUMENTS

| | | | | |
|---|---|---|---|---|
| 5,407,199 | A * | 4/1995 | Gumina | 273/139 |
| 7,036,821 | B2 | 5/2006 | Hall | |
| 7,435,172 | B2 | 10/2008 | Hall | |
| 7,654,894 | B2 * | 2/2010 | Lutnick et al. | 463/13 |
| 2003/0090063 | A1 * | 5/2003 | Jarvis et al. | 273/292 |
| 2003/0199313 | A1 * | 10/2003 | Gonen et al. | 463/25 |
| 2007/0138744 | A1 | 6/2007 | Hall | |
| 2007/0284821 | A1 | 12/2007 | Hall | |
| 2008/0227537 | A1 | 9/2008 | Hall | |
| 2008/0261682 | A1 * | 10/2008 | Phillips et al. | 463/25 |

* cited by examiner

*Primary Examiner* — Peter DungBa Vo
*Assistant Examiner* — Wei Li
(74) *Attorney, Agent, or Firm* — Muskin & Cusick LLC

(57) ABSTRACT

A method, system, and computer readable storage medium to provide a variation of a blackjack game. The player does not make any strategy decisions as the player must play his or her hand out according to a predetermined strategy. The dealer also players his or her hand out according to a predetermined strategy.

15 Claims, 4 Drawing Sheets

BLACKJACK VARIATION WITH REDUCED PLAY DECISIONS

CROSS REFERENCE TO RELATED APPLICATIONS

This application claims benefit to U.S. provisional application 61/113,563, filed on Nov. 11, 2008, which is incorporated by reference herein in its entirety.

BACKGROUND OF THE INVENTION

1. Field of the Invention

The present inventive concept relates to a system, method, and computer readable storage, for playing a variation of a casino blackjack game.

2. Description of the Related Art

Casino blackjack games are known in the art. What is needed is a new variation of casino blackjack game that some players may find more simple and enjoyable than the standard version of blackjack.

SUMMARY OF THE INVENTION

It is an aspect of the present general inventive concept to provide an easy to learn variation of blackjack.

The above aspects can also be obtained by a method that includes (a) receiving a main wager from a player; (b) dealing a player's hand and a dealer's hand; (c) unless the player's hand is greater than a predetermined point total, continuing to deal additional cards to the player's hand, wherein if the player busts then the player bust card is disregarded; (d) unless the dealer's hand is greater than a predetermined point total, continuing to deal additional cards to the dealer's hand, wherein if the dealer busts then the dealer bust card is disregarded; and (e) determining whether the player or the dealer has the higher hand, wherein if the player has the higher hand then paying the main wager to the player and if the dealer has the higher hand then collecting the main wager from the player.

These together with other aspects and advantages which will be subsequently apparent, reside in the details of construction and operation as more fully hereinafter described and claimed, reference being had to the accompanying drawings forming a part hereof, wherein like numerals refer to like parts throughout.

BRIEF DESCRIPTION OF THE DRAWINGS

Further features and advantages of the present invention, as well as the structure and operation of various embodiments of the present invention, will become apparent and more readily appreciated from the following description of the preferred embodiments, taken in conjunction with the accompanying drawings of which.

DESCRIPTION OF THE PREFERRED EMBODIMENTS

Figure 1:
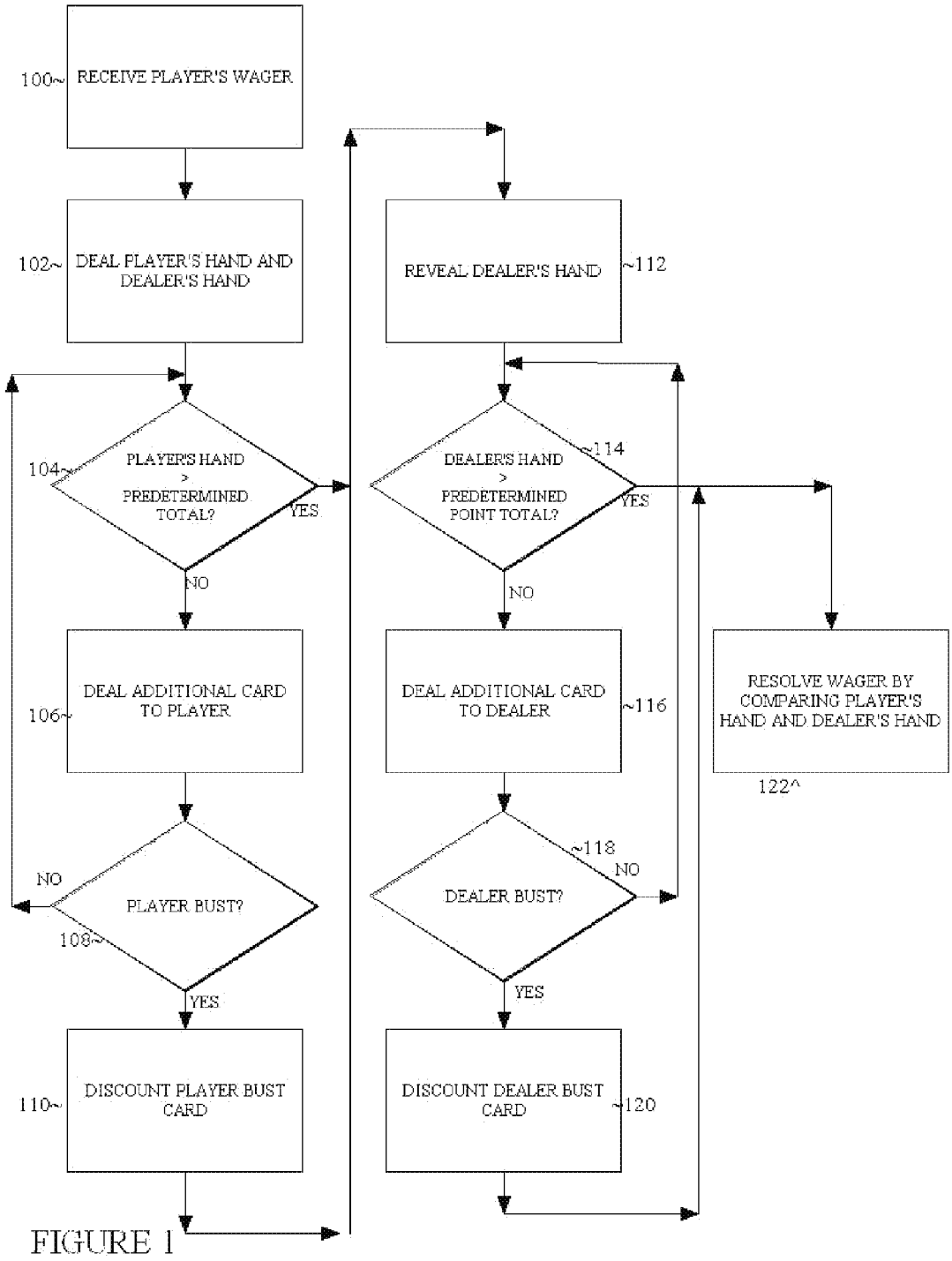
FIG. 1 is a flowchart illustrating an exemplary method of implementing a wagering game, according to an embodiment.

Reference will now be made in detail to the presently preferred embodiments of the invention, examples of which are illustrated in the accompanying drawings, wherein like reference numerals refer to like elements throughout.

The general inventive concept relates to a game involving blackjack. Blackjack is a well known game in the art, for example see U.S. patent publication 2003/0155715, which is incorporated by reference here in its entirety.

Some casino players who do not know how to play blackjack may be intimidated to sit down at a blackjack table due to what some may perceive as a complicated game which requires a complex player strategy. Furthermore, if a player does not play with a reasonable player strategy, the player could be giving the house (casino) a huge advantage.

In an embodiment of the general inventive concept, a blackjack variation is provided which is simpler and easier for players to learn than the standard game of blackjack. No player strategy is needed, as the player's decisions are all automatic.

FIG. 1 is a flowchart illustrating an exemplary method of implementing a wagering game, according to an embodiment.

The method can begin with operation 100, which receives the player's wager. This can be done as known in the art. For example, the player can place his or her wager in the form of chips on a respective betting circle on a gaming table. The chips are directly redeemable for cash at a casino cashier.

From operation 100, the method proceeds to operation 102, which deals the player's hand and the dealer's hand. Typically, the player is dealt two cards and the dealer is dealt two cards. The player's two cards can be dealt face up or face down. The dealer's two cards can be dealt face up or face down (which will then be revealed in operation 112). Alternatively, one dealer's card can be dealt face up (the "up-card") and one dealer's card can be dealt face down (the "hole-card").

If the player is dealt a blackjack (a 10-valued card and an ace), and the dealer is not dealt a blackjack, then the player automatically wins even money (or alternatively a special payout such as 3:2). If the dealer is dealt a blackjack and the player is not dealt a blackjack, then the player automatically loses. If both the player and the dealer are dealt blackjacks, then the outcome can be considered a tie (see below discussion).

From operation 102, the method can proceed to operation 104, which determines whether the player's hand is greater than (or greater than or equal to) a predetermined point total. For example the predetermined point total can be 16 (but it can be any other number as well, e.g., 15, or another number). Thus, if the player's hand is greater than 16, then the result would be "yes," while if the player's hand is not greater than 16 then the result would be "no."

If in operation 104, it is determined that the player's hand is not greater than the predetermined point total, then the method proceeds to operation 106, which deals an additional card to the player. The additional card can be dealt face up or face down. The additional card becomes part of the player's hand. If in operation 104, it is determined that the player's hand is greater than the predetermined point total, then the method proceeds to operation 112, to be discussed below in more detail.

From operation 106, the method proceeds to operation 108, which determines whether the player busts. If the player's point total (the sum total of all of the cards in the player's hand) is greater than 21 then the player has busted. Aces typically count as 11 or 1. All aces in the player's hand should be counted as 1 (not 11) before determining that the player has busted (in other words, no matter how the aces are counted, the player must bust). If the player has not busted, then the method returns to operation 104.

If in operation 108, it is determined that the player has busted, then the method proceeds to operation 110, which discounts (disregards) the player bust card (the last card dealt which caused the player to bust). The player bust card will not be used in determining the player's point total of the player's hand. Thus the player bust card can be discarded (e.g., put into a discard rack), or it can remain on the table but its value will be ignored when tabulating the player's point total (e.g., it will not be part of the player's hand). In this manner, it would be impossible for the point total of the player's hand to be over 21.

From operation 110, the method can proceed to operation 112, which reveals the dealer's hand. If the dealer's hand has already been revealed (e.g., the dealer's hand was dealt face up in operation 102), then this operation is not necessary.

From operation 112, the method proceeds to operation 114, which determines whether the dealer's hand (e.g., the point total of all cards in the dealer's hand) is greater than (or greater than or equal to) a predetermined point total (can be any number, such as 15, 16, or any other number). The predetermined point total in operation 114 can be the same as the predetermined point total in operation 104, or it can be different. If the dealer's hand is determined to be greater than the predetermined point total, then the method proceeds to operation 122, to be discussed below in more detail.

If the dealer's hand is not greater than the predetermined point total in operation 114, then the method proceeds to operation 116, which deals an additional dealer card to the dealer. The additional dealer card would typically be dealt face up.

From operation 116, the method proceeds to operation 118, which determines whether the dealer busts or not. If the dealer's point total (the sum total of all of the cards in the dealer's hand) is greater than 21 then the dealer has busted. Aces typically count as 11 or 1. All aces in the dealer's hand should be counted as 1 (not 11) before determining that the dealer has busted (in other words, no matter how the aces are counted, the dealer must bust). If the dealer has not busted, then the method returns to operation 114.

If in operation 118, it is determined that the dealer has busted, then the method proceeds to operation 120, which discounts (disregards) the dealer bust card (the last card dealt to the dealer that caused the dealer to bust). The dealer bust card can optionally be removed from the table and put into a discard rack. Or the dealer bust card can remain on the table but its existence will be discounted, that is, it will not be considered when evaluating the dealer's hand. Thus, it will be impossible for the dealer to have a bust hand (hand higher than 21). From operation 120, the method can proceed to operation 122.

In operation 122, both the player's hand and the dealer's hand have been played out to completion and revealed. Thus, in operation 122, the wager (placed in operation 100) is now resolved by comparing the player's hand and the dealer's hand.

If the player's hand (i.e., the sum of all values of all cards in the player's hand not including any discounted cards) is greater than the dealer's hand (i.e., the sum of all values of all cards in the dealer's hand not including any discounted cards), then the player wins and can be paid off on the player's wager placed in operation 100. Typically, a winning wager can be paid at even money (1:1).

If the player's hand is less than the dealer's hand, then the player loses the player's wager, and the player's wager (placed in operation 100) is collected by the dealer.

If the player's hand equals the dealer's hand (i.e., the player's point total and the dealer's point total are equal regardless of the actual cards used therein), then this is considered a tie. This can be handled in numerous ways. In one embodiment, the player loses half (or other fraction) of the player's wager on a tie (e.g., if the player bet $10, the player would lose $5 and keep the remaining $5 and the game is now over). In this manner, the house can maintain an advantage over the player by collecting something on ties. In another embodiment, the player can lose the entirety of the player's wager on a tie.

In a further embodiment, the player does not win or lose on a tie (the player "pushes"). Instead, the house gets their advantage by taking a commission of all winning wagers by the player. For example, the house can collect a 5% (or any other percentage) vigorish on all wagers that the player wins.

It is noted that the operations in FIG. 1 can be performed in any order. For example, the dealer's hand does not have to be dealt in operation 102 but can instead be dealt in operation 112.

An example of the game is as follows, with the predetermined point total to stop hitting (for both the player and the dealer being 16). The cards dealt are random and for illustrative purposes. Player 1 wagers $1 and player 2 wagers $2. Player 1 is initially dealt a King and a 4 as his/her first 2 cards, and player 2 is dealt a 9 and 6 as his/her first 2 cards. The dealer is dealt a seven as the dealer's upcard and a hole card (not revealed to the player).

Since player 1 only has a total of 14 (which is not greater than 16), the dealer deals an additional card to the player which is a 5. This now makes a total of 19 for the player and he/she now has to stay on that total (since 19 is greater than 16). Now it is player 2's turn. Player 2's total only totals 15 (which is not greater than 16), so then the dealer deals another card to the player. This time the card is a 7 which, in the regular game of 'Blackjack', would cause the player to bust (exceed 21) However, in this game, the dealer simply removes the '7' so that the player 2's hand is now reverted to the original total of '15'. Player 2's hand is now complete at 15.

Now it is the dealer's turn. The dealer's hole card is revealed to be a 9, thus the dealer's point total is 16. Since 16 is not greater than 16, the dealer deals the dealer an additional card, which turns out to be a queen (jacks, queens, and kings all have a value of 10). Thus, the dealer has busted (has a point total of 26 which is greater than 21) and thus the dealer's bust card (the last card dealt to the dealer) is discounted (disregarded, not used). Thus, the dealer's point total is 16. Player 1's hand (point total) of 19 is higher than the dealer's hand (point total) of 16, and thus the player wins a $1 on his original $1 wager. The dealer's point total of 16 is higher than player 2's point total of 15, and thus player 2 loses (the dealer wins) and thus player 2 loses his or her $2 wager.

Figure 2:
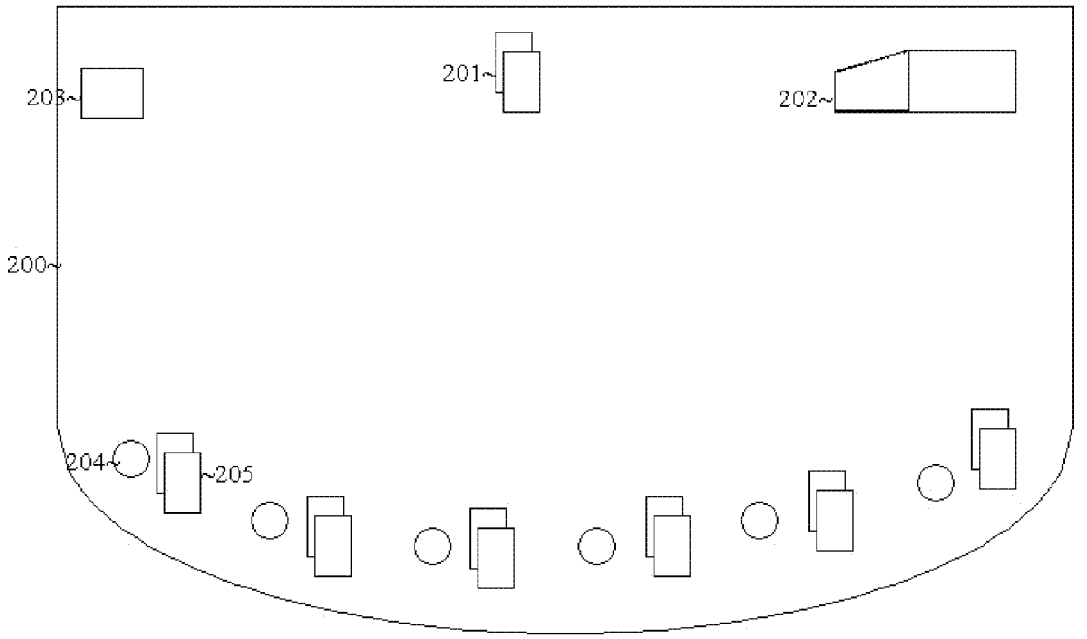
FIG. 2 is a drawing illustrating an exemplary table layout of implementing wagering methods, according to an embodiment.

FIG. 2 is a drawing illustrating an exemplary table layout of implementing wagering methods, according to an embodiment.

A gaming table 200 is a standard gaming table apparatus, as known in the art. The gaming 200 has a table felt which has graphics of the betting circles. A dealer's hand 201 is dealt as described herein. A card shoe 202 is used to store cards to be dealt. A discard rack 203 (or discard tray) is used to receive discards (cards that are no longer in play).

A main wager betting circle 204 is used to place the player's main wager, as described in operation 100. A player's hand 205 is dealt as described herein.

The gaming table 200 shown can accommodate six simultaneous players, although such tables can accommodate any other numbers of players as well. Each player is dealt their hand, then each player plays out their hand in turn (as described herein). When all players are done playing out their hand, then the dealer plays out his or her hand (as described herein). Then each players' respective wager is resolved according to the comparison of their respective hand and the dealer's hand. Thus, some players can win while other players can lose against the same dealer hand.

In a further embodiment, the methods described herein can be played "baccarat style." The game of baccarat is well known in the art and is described in U.S. Pat. No. 5,876,283, which is incorporated by reference herein in its entirety. In the game of baccarat, two hands are dealt, one for the dealer (or "banker") and one for the "player" (although the "player in baccarat does not refer to a particular player). Each player can bet on who they think will win, either the player or the dealer. The choice is made by putting a wager in a respective betting circle ("player" or "dealer"). After the player's hand and the dealer's hand are played out and a winner is determined, then the winning bets are paid and the losing bets are taken.

Figure 3:
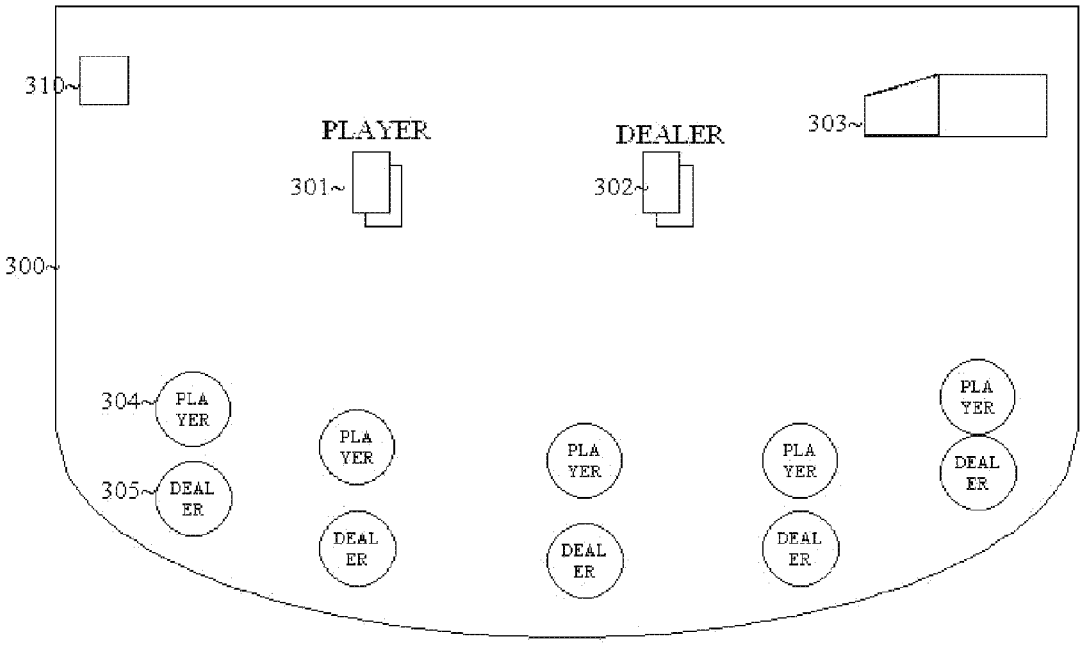
FIG. 3 is a drawing illustrating an exemplary table layout of implement wagering methods in a baccarat style, according to an embodiment.

FIG. 3 is a drawing illustrating an exemplary table layout of implement wagering methods in a baccarat style, according to an embodiment.

A gaming table 300 is used to implement the game. A player's hand 301 and a dealer's (or "bankers") hand 302 are dealt. A card shoe 303 is used to hold the cards and a discard rack 310 can be used to receive discards.

A player's betting circle 304 (to bet on the player's hand 301) and a dealer's betting circle 305 (to bet on the dealer's hand 302) are used to receive the bettor's choice of which hand the player wishes to bet on. This table can accommodate up to five bettors, although of course such a table can accommodate any number of bettors. All of the bettors are betting on a game involving the same player's hand 301 and the same dealer's hand 302. Thus, bettors who bet on the player will win or lose together, and all bettors who bet on the dealer will win or lose together.

The house (casino) can take a commission on all winning wagers in order to provide the house advantage. Alternatively, in event of a tie, all wagers (either on the player or on the dealer) will lose a fraction of their value or be lost in their entirety.

The baccarat style version illustrated in FIG. 3 can be implemented as described in FIG. 1 with the modification that in operation 100, the bettor (or player) places the main wager on either the player (using the player's betting circle 304) or the dealer (using the dealer's betting circle 305). In operation 122, when the wagers are resolved, the winner is determined (either the player or the dealer) based on who has the higher hand. Then, if the player chose correctly in operation 100 (e.g., bet on the player and the player wins, or bet on the dealer and the dealer wins) then the player wins a payout on the main wager, and if the player chose incorrectly in operation 100 (e.g., bet on the player and the dealer wins or bet on the dealer and the player wins), then the player loses his or her main wager.

An example of the baccarat style version of the game will now be presented, with both the player's predetermined point total and the dealer's predetermined point total being 16. Bettor 1 bets $2 on the player, while Bettor 2 bets $1 on the dealer. The dealer deals a player's hand comprising an 8-heart and 3-spades (although typically the suits do not matter). The dealer deals a dealer's hand of a 10-clubs and a 7-hearts. Since the player's point total of 11 is not greater than 16, then the player receives an additional card which is a 10-hearts giving the player a total of 21. Since the dealer has a point total of 17 which is greater than 16, the dealer stands on the 17. The player's point total of 21 is greater than the dealer's point total 17, and thus the player wins. Thus, bettor 1 wins a $2 payout on his original $2 wager since bettor 1 originally bet that the player will win, while bettor 2 loses his $1 wager since he originally bet that the dealer would win.

In a further embodiment, the player and/or the dealer could be standard on a 'hard' point total (where no aces or used or aces count as 1) but hit on a 'soft' point total (where at least one ace counts as 11). For example, both the player and dealer can stay if their point total is greater than 16 (17 or higher) with the exception that soft 17's (a seventeen created using an ace which counts as 11, for example an ace and a six) will be hit.

In a further embodiment, the player would be allowed to split and double as in regular blackjack.

In yet a further embodiment, only the player would be allowed the "no bust" feature and have his bust card discounted, while the dealer plays as standard blackjack which allows for a dealer bust. Or alternatively, only the dealer would be allowed the "no bust" feature and have his bust card discounted while the player plays according to standard blackjack rules which allows for the player to bust.

In yet another embodiment, suited blackjacks could be paid at a higher payout than non-suited blackjacks.

In a further embodiment, a player who ties the dealer may be subject to a disadvantage on the next hand instead of losing some or all of their wager. For example, on event of a tie, on the following hand the player may not be able to use the "no bust" feature (e.g., have his bust card discounted), or the player must win their next hand in order to have their previous wager returned.

In another embodiment, only certain totals that tie with the dealer are subject to a penalty (e.g., 17-21) which lose one half of the wager amount, while ties on other point totals merely push (neither win or lose anything).

In yet a further embodiment, a dealer's bust total could be used to push the whole table. For example, a dealer's total of 26 (or any other individual total) could result in all bets being pushed on the table. In addition, a low total, e.g., 12-13, could also be used to push all bets on the table.

In another embodiment, any hand containing at least a predetermined number of cards would automatically win.

In yet another embodiment, if the player has blackjack and the dealer has blackjack, the player still wins.

In another embodiment, the dealer's predetermined point total and the player's predetermined point total may be different. For example, if the player's hand is not greater than 18 (the player's point total from operation 104) the player must draw, while if the dealer's hand is not greater than 17 (the dealer's predetermined point total from operation 114) the dealer must draw.

Figure 4:
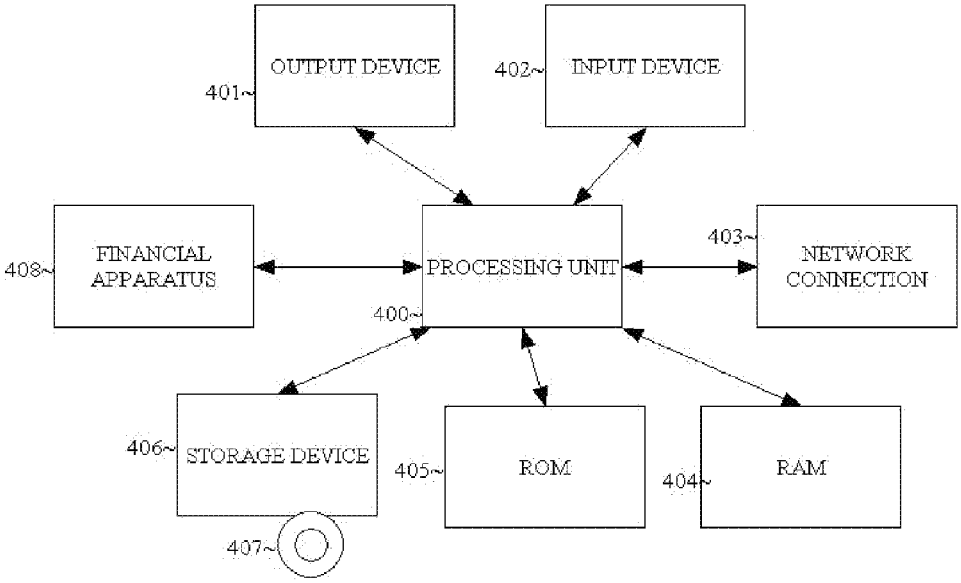
FIG. 4 is a block diagram illustrating hardware that can be used to implement the wagering methods, according to an embodiment.

FIG. 4 is a block diagram illustrating hardware that can be used to implement the wagering methods, according to an embodiment. The hardware can be, for example, a gaming machine used in a casino.

A processing unit 400 (such as a microprocessor and any associated components) is connected to an output device 401 (such as an LCD monitor, touch screen, CRT, etc.) and an input device 402 (e.g., buttons, a touch screen, a keyboard, mouse, etc.) The processing unit 400 can also be connected to a network connection 403, which can connect the electronic gaming device to a computer communications network such as the Internet, a LAN, WAN, etc. The processing unit 400 is also connected to a RAM 304 and a ROM 405. The processing unit 400 is also connected to a storage device 406 which can be a DVD-drive, CD-ROM, flash memory, etc. A computer readable storage medium 407 can store a program which can control the electronic device to perform any of the methods described herein. The processing unit 400 can also be connected to a financial apparatus 408 which can receive cash and convert the received cash into playable credits for use by the player when playing the electronic device. When the player decides to cash out any remaining credits, the financial apparatus 408 can issue coins or a cashless ticket (voucher) for the remaining credits which is redeemable by the player.

It is noted that the methods described herein can be played using any number of decks (e.g., 1-8 or more), physical or virtual (on a computer). Standard decks of 52 cards can be used, as well as other kinds of decks, such as Spanish decks, decks with wild cards, etc. The operations described herein can be performed in any sensible order. Furthermore, numerous different variants of house rules can be applied. For example, in blackjack, the dealer can hit on soft 17 or stand on soft 17, depending on house rules. Cards can be given their standard point values as known in the art (e.g., 2-10 have their face value, jack, queen, and king, have a point value of 10, and ace has a point value of 1 or eleven).

Wagers placed by the player can be placed in the form of cash or chips which are redeemable for cash. When the player loses a wager, the chip(s) are physically collected by the dealer. When the player wins a wager, the chip(s) are physically paid by physically moving chips in the dealer's possession to the player's betting circle.

In addition to chips, other equipment can be used as well, such as standard gaming tables with table felts indicating the betting circles, card shuffles, card shoes, etc.

The descriptions provided herein also include any hardware and/or software known in the art and needed to implement the operations described herein. Further, all methods described herein can be programmed on a digital computer and stored on any type of computer readable storage medium.

The many features and advantages of the invention are apparent from the detailed specification and, thus, it is intended by the appended claims to cover all such features and advantages of the invention that fall within the true spirit and scope of the invention. Further, since numerous modifications and changes will readily occur to those skilled in the art, it is not desired to limit the invention to the exact construction and operation illustrated and described, and accordingly all suitable modifications and equivalents may be resorted to, falling within the scope of the invention.

What is claimed is:

1. A method to play a blackjack game, the method comprising:

executing, on an electronic processing unit, computer readable instructions to perform the following operations:

receiving a main wager from a player to play the game;

dealing a player's hand and a dealer's hand using one or more virtual decks of cards;

unless the player's hand is greater than a predetermined point total, continuing to deal additional cards from the one or more virtual decks of cards to the player's hand, wherein if the player busts then a player bust card is disregarded while a player remains in the game;

unless the dealer's hand is greater than a predetermined point total, continuing to deal additional cards from the one or more virtual decks of cards to the dealer's hand, wherein if the dealer busts then a dealer bust card is disregarded while the dealer remains in the game;

determining whether the player or the dealer has the higher hand;

resolving the wager according to a following wager resolution rules which comprise: if the player has the higher hand then paying a payout on the main wager to the player and if the dealer has the higher hand then collecting the main wager from the player; and ending the game.

2. The method as recited in claim 1, wherein if the dealer's hand and the player's hand tie, then some or all of the main wager is collected from the player.

3. The method as recited in claim 1, wherein the predetermined point total for the player's hand is 16.

4. The method as recited in claim 1, wherein the predetermined point total for the dealer's hand is 16.

5. The method as recited in claim 1, wherein the dealer takes a commission on all winning wagers from the player.

6. A method to play a blackjack game, the method comprising:

executing, on an electronic processing unit, computer readable instructions to perform the following operations:

receiving a main wager to play the game from a bettor on the player or on the dealer;

dealing a player's hand and a dealer's hand using one or more virtual decks of cards;

unless the player's hand is greater than a predetermined point total, continuing to deal additional cards from the one or more virtual decks of cards to the player's hand, wherein if the player busts then a player bust card is disregarded while the player's hand remains in the game;

unless the dealer's hand is greater than a predetermined point total, continuing to deal additional cards from the one or more virtual decks of cards to the dealer's hand, wherein if the dealer busts then a dealer bust card is disregarded while the dealer's hand remains in the game;

determining whether the player or the dealer has the higher hand, resolving the wager according to a following wager resolution rules which comprise: if the main wager is on the player then if the player has the higher hand then paying a payout on the main wager and if the dealer has the higher hand then collecting the main wager, and if the main wager is on the dealer then if the player has the higher hand then collecting the main wager and if the dealer has the higher hand then paying a payout on the main wager; and ending the game.

7. The method as recited in claim 6, wherein if the dealer's hand and the player's hand tie, then some or all of the main wager is collected from the bettor regardless of whether the main wager was on the player or on the dealer.

8. The method as recited in claim 6, wherein the predetermined point total for the player's hand is 16.

9. The method as recited in claim 6, wherein the predetermined point total for the dealer's hand is 16.

10. The method as recited in claim 6, wherein the dealer takes a commission on all winning wagers from the bettor.

11. A electronic gaming apparatus to play a blackjack game, the apparatus comprising:

an input device and an output device;

a processing unit connected to the input device and the output device, the processing unit configured to perform:

receiving a main wager from a player to play the game;

dealing a player's hand and a dealer's hand using one or more virtual decks of cards;

unless the player's hand is greater than a predetermined point total, continuing to deal additional cards from the one or more virtual decks of cards to the player's hand, wherein if the player busts then a player bust card is disregarded while the player remains in the game;

unless the dealer's hand is greater than a predetermined point total, continuing to deal additional cards from the one or more virtual decks of cards to the dealer's hand, wherein if the dealer busts than a dealer bust card is disregarded while the dealer remains in the game;

determining whether the player or the dealer has the higher hand; and if the player has the higher hand then paying a payout on the main wager to the player and if the dealer has the higher hand then collecting the main wager from the player.

12. The apparatus as recited in claim 11, wherein if the dealer's hand and the player's hand tie, then some or all of the main wager is collected from the player.

13. The apparatus as recited in claim 11, wherein the predetermined point total for the player's hand is 16.

14. The apparatus as recited in claim 11, wherein the predetermined point total for the dealer's hand is 16.

15. The apparatus as recited in claim 11, wherein the dealer takes a commission on all winning wagers from the player.

* * * * *